US007644800B2

(12) United States Patent
Adachi et al.

(10) Patent No.: US 7,644,800 B2
(45) Date of Patent: Jan. 12, 2010

(54) MOTORCYCLE EXHAUST STRUCTURE

(75) Inventors: Eiji Adachi, Saitama (JP); Yuji Noguchi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 323 days.

(21) Appl. No.: 11/709,175

(22) Filed: Feb. 22, 2007

(65) Prior Publication Data

US 2007/0193812 A1 Aug. 23, 2007

(30) Foreign Application Priority Data

Feb. 23, 2006 (JP) ..... 2006-047582

(51) Int. Cl.
*B62M 7/04* (2006.01)

(52) U.S. Cl. ..... 180/309; 180/219

(58) Field of Classification Search ..... 180/309, 180/219

See application file for complete search history.

(56) References Cited

U.S. PATENT DOCUMENTS 4,620,713 A * 11/1986 Sakaguchi ..... 280/152.3
5,271,477 A * 12/1993 Gekka et al. ..... 180/219
7,350,351 B2 * 4/2008 Ueshima et al. ..... 60/299

FOREIGN PATENT DOCUMENTS

DE 196 34 887 A1 3/1998
FR 2 543 078 A3 9/1984
GB 322249 12/1929
JP 61-205319 A 9/1986
JP 8-25502 A 1/1996
JP 08099669 A * 4/1996
JP 2002-211469 A 7/2002
JP 2004-26007 A 1/2004

OTHER PUBLICATIONS

Bruton et al., Canadian Motorcycle Guide Online, "Part 1—KTM 4,5, 200 EXC," Dec. 20, 2001, http://www.cmgonline.com/articles/CMG01/bikes/KTM/200 EXC/home.html.

* cited by examiner

*Primary Examiner*—Kevin Hurley
(74) *Attorney, Agent, or Firm*—Birch, Stewart, Kolasch & Birch, LLP

(57) ABSTRACT

To place a muffler in a front area to make it suitable for an off-road motorcycle, A down frame extending downward obliquely from a head pipe ahead of an engine and a lower frame connected with its lower end, extending backward under the engine, are provided. A muffler is located in the vicinity of the joint between the down frame and the lower frame where its rear surface is curved forward in a convex pattern along the down frame and the lower frame. An exhaust pipe extending from a cylinder head is almost S-shaped as seen sideways and its forward curved portion and lower backward curved portion are vertically arranged with its lower end connected with a lower portion of the muffler.

18 Claims, 7 Drawing Sheets

MOTORCYCLE EXHAUST STRUCTURE

CROSS-REFERENCE TO RELATED APPLICATIONS

This nonprovisional application claims priority under 35 U.S.C. § 119(a) on Patent Application No. 2006-047582, filed in Japan on Feb. 23, 2006, the entirety of which is incorporated herein by reference.

FIELD OF THE INVENTION

The present invention relates to a motorcycle exhaust structure. In particular, the present invention relates to a motorcycle exhaust structure that is suitable for an off-road vehicle.

DESCRIPTION OF BACKGROUND ART

A motorcycle exhaust structure is known, wherein a main frame extending downward obliquely and backward from a head pipe supporting a front wheel is provided. A V-type engine is held under the main frame. An exhaust pipe extending from a cylinder of the engine is connected to a muffler divided into two portions before and after an oil pan under a crankcase. The rear muffler portion is larger than the front muffler portion (see JP-A No. 2004-26007).

SUMMARY OF THE INVENTION

In a situation where a muffler like the above known one is located under a crankcase, a relatively large and heavy muffler may be located in a lower portion of a vehicle body. This arrangement is suitable for an on-road motorcycle, which is requested to be able to move its body agilely by placing a heavy component in a position as low as possible in the body, thus reducing the inertia force when inclining the body left or right.

However, in an off-road motorcycle, since its cylinder should be upright and the minimum road clearance should be high in order to ensure that the engine is longitudinally short, it is impossible to place a muffler under a crankcase. Therefore, this application has an object to make it possible that a muffler is located near a head pipe even in such an off-road motorcycle.

In order to address the above problem, a first aspect of the present invention is directed to a motorcycle exhaust structure, wherein a motorcycle includes a body frame with a head pipe supporting a front wheel that supports an engine. The engine includes a crankcase in a lower position and a cylinder extending upward from the crankcase. An exhaust pipe extending from the cylinder is connected with a muffler. The muffler is located ahead of the crankcase and behind the front wheel with a front suspension in its retracted position and above a lower end of the body frame.

According to a second aspect of the present invention, the body frame has a front frame extending downward from the head pipe and extending downward from ahead of the engine and a rear surface of the muffler is curved along the front frame.

According to a third aspect of the present invention, a high front fender is located above the front wheel and the muffler is located under a rear end of the front fender.

According to a fourth aspect of the present invention, the exhaust pipe is connected with an upper front of the cylinder and the exhaust pipe includes an upper forward curved portion and a lower backward curved portion and the backward curved portion is connected with a rear lower portion of the muffler.

According to a fifth aspect of the present invention, the exhaust pipe is connected with an upper front of the cylinder and the exhaust pipe includes a side curved portion extending down while curving on one side of the body. A horizontally extended portion extends from a lower end of the side curved portion ahead of the crankcase in a transverse direction of a body and bending in an opposite direction. An exhaust downstream end of the horizontally extended portion is connected with the inside of the muffler.

According to the first aspect of the present invention, the muffler is located ahead of the crankcase and behind the front wheel with the front suspension in its retracted position and above a lower end of the body frame. Therefore, the muffler can be near the head pipe. Therefore, when the vehicle body moves centering around the head pipe, the inertia force is reduced. Moreover, the minimum road clearance can be high, which is suitable for an off-road motorcycle.

In addition, when the front and rear of the vehicle body move vertically on an uneven road surface, since the muffler is near the engine, heavy components are concentrated in the vicinity of the center of the body. As a consequence, the inertia force is reduced, thereby decreasing vertical movement of the front and rear of the body.

According to the second aspect of the present invention, a rear surface of the muffler is curved along the front frame extending downward from the head pipe and extending downward from ahead of the engine. Therefore, despite the presence of the front frame, the muffler can be located ahead of the crankcase and near the front frame, permitting the engine to lie in a more forward position.

According to the third aspect of the present invention, a high front fender is located above the front wheel and the muffler is located under a rear end of the front fender. Therefore, the muffler can be in a position not to interfere with the front fender.

According to the fourth aspect of the present invention, the exhaust pipe extending from the upper front of the cylinder includes an upper forward curved portion and a lower backward curved portion and the backward curved portion is connected with the rear lower portion of the muffler. Therefore, a sufficiently long exhaust pipe length is ensured.

According to the fifth aspect of the present invention, the exhaust pipe includes a side curved portion extending downward while curving on one side of the body, and a horizontally extended portion extending from the lower end of the side curved portion ahead of the crankcase in a transverse direction of the body and bending back, and the exhaust downstream end of the horizontally extended portion is connected with the muffler. Therefore, it is ensured that the exhaust pipe is sufficiently long and can be arranged in a compact manner by taking advantage of the inside of the large-capacity muffler extending transversely.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
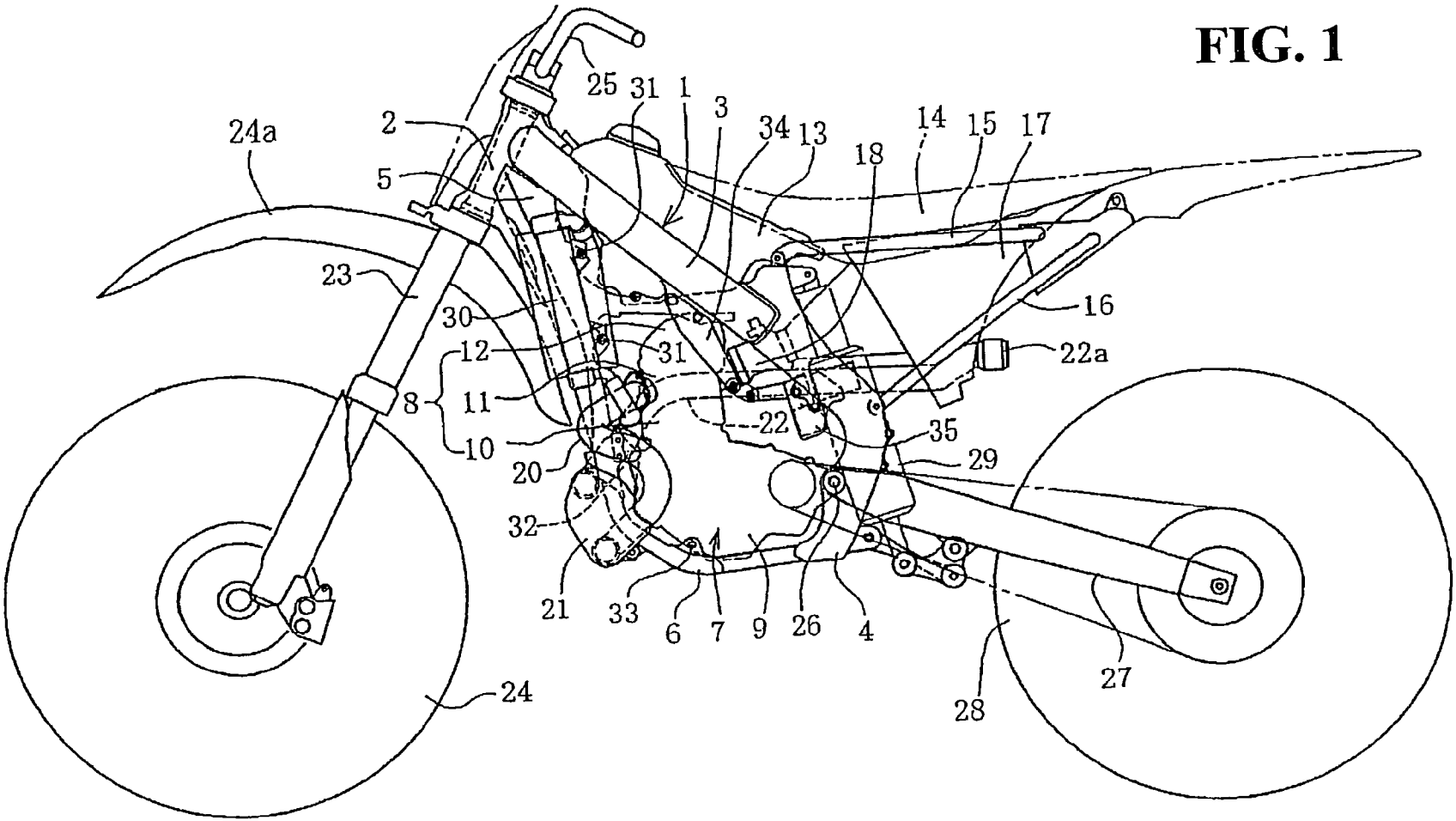
FIG. 1 is a side view of a motorcycle according to an embodiment.

An embodiment will now be described with reference to the accompanying drawings, wherein the same or similar elements will be identified with the same reference numeral throughout the several views.

FIG. 1 is a side view of an off-road motorcycle to which a body frame structure according to this embodiment is applied. The body frame 1 of this motorcycle includes a head pipe 2, a main frame 3, a center frame 4, a down frame 5 and a lower frame 6, which are connected in a loop-like manner with an engine 7 held inside the loop. The down frame 5 and the lower frame 6 constitute a front frame in this application. The constituent parts of the body frame 1 are each made of appropriate metal materials such as aluminum alloy. The head pipe 2 and the center frame 4 are castings. The main frame 3 and the lower frame 6 are square pipe wrought products made by extrusion molding. The down frame 5 is a combination of a wrought product and a casting.

The main frame 3 extends straight downward obliquely and backward above the engine 7 and joins the upper end of the center frame 4 extending vertically behind the engine 7. The down frame 5 extends downward obliquely ahead of the engine 7 with its lower end connected to the front end of the lower frame 6. The lower frame 6 curves from the front lower portion of the engine 7 to an area under the engine 7 and then extends almost straight backward with its rear end connected to the lower end of the center frame 4.

The engine 7 is a water-cooled 4-cycle engine with a cylinder 8 and a crankcase 9. The cylinder 8, located on the front of the crankcase in an upright position with its cylinder axis line almost vertical, includes a cylinder block 10, a cylinder head 11 and a head cover 12.

A fuel tank 13 is located above the engine 7 and is held on the main frame 3. A seat 14 is located behind the fuel tank 13. The seat 14 is held on a seat rail 15 that extends backward from the upper end of the center frame 4. Reference numeral 16 represents a reinforcing pipe located under the seat rail 15. The seat rail 15 and the reinforcing pipe 16 support an air cleaner 17. Air is taken into the cylinder head 11 through a throttle body 18 from behind the body.

An exhaust pipe 20, extending downward from the front of the cylinder head 11 ahead of the engine 7, is connected to the muffler 21 located in front of the crankcase 9. A tail pipe 22 extends backward from the muffler 21, crossing the center frame 4 behind which its rear end is supported by the reinforcing pipe 16.

The head pipe 2 supports a telescopic front fork 23, constituting a front suspension. A front wheel 24 supported by its lower end is steered by a handlebar 25. The center frame 4 swingably supports the front end of a rear arm 27 through a pivot shaft 26. A rear wheel 28 is supported by the rear end of the rear arm 27 and is driven through a chain by the engine 7. A cushion unit 29 as a rear suspension is provided between the rear arm 27 and the rear end of the center frame 4.

Reference numeral 30 represents a radiator; 31 a rubber mounting part for the radiator; 32 and 33 engine mounting parts; 34 an engine hanger; and 35 an electric component case. The center frame 4 also supports the engine 7 through the pivot shaft 26.

Figure 2:
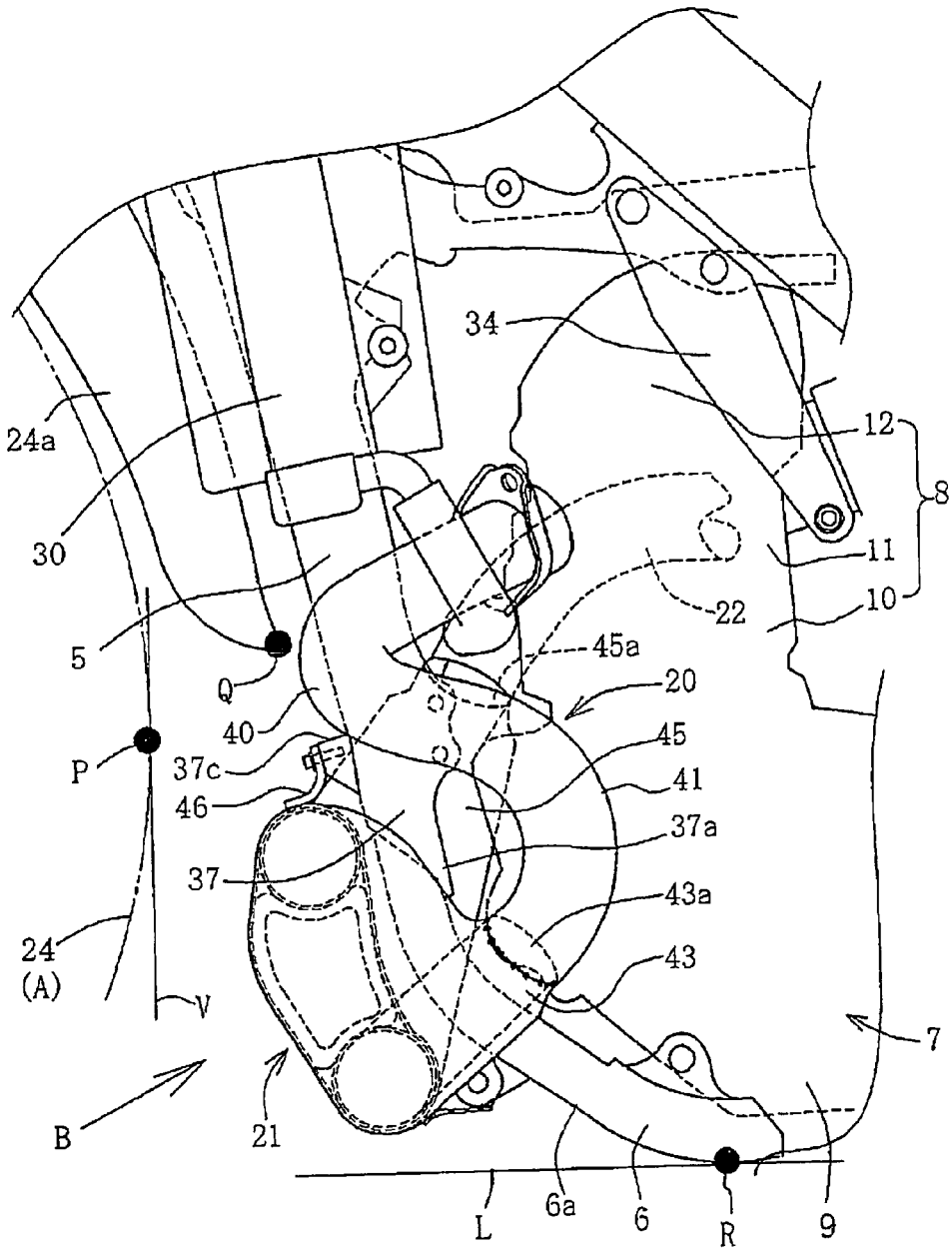
FIG. 2 is an enlarged side view mainly showing a muffler.

FIG. 2 is an enlarged side view showing the muffler 21 and its vicinity. The exhaust pipe 20 is curved almost in an S pattern as seen sideways where its upper forward-curved portion 40 protrudes forward from the cylinder head 11 and curves forward in a convex pattern while its lower backward-curved portion 41 curves backward in a convex pattern with its lower end connected with the muffler 21. The muffler 21 is held on the lower frame 6 by its stay 42 extending backward from its back bottom being fitted to a stay **6*b* of a front-end 6*a* of the lower frame 6. The front end 6*a* of the lower frame 6 is a portion curving upward so that that the lower frame 6 runs under the crankcase 9** and turns around it to come in front of it.

The muffler 21 is located in a way to cover an area in front of the vicinity of the joint between the lower end of the down frame 5 and the lower frame 6. The muffler 21, virtually in the form of a triangle with its front middle part convex forward as seen sideways, is located in a position and a form not to interfere with the front wheel 24 in its higher limit position (indicated by virtual line A) with the front fork 23 in its most retracted position.

The muffler 21 is behind a vertical line V passing through point P as the rearmost end of the front wheel 24 in its position as indicated by the virtual line A. It is also under the respective vicinities of point Q as the rear end of the high front fender **24*a*, and point P, and the points themselves. Also it is located ahead of point R as the bottom of the lower frame 6 and slightly above a horizontal line L passing through point R. Point R is also the point of minimum road clearance of the body frame 1** as a whole.

Figure 3:
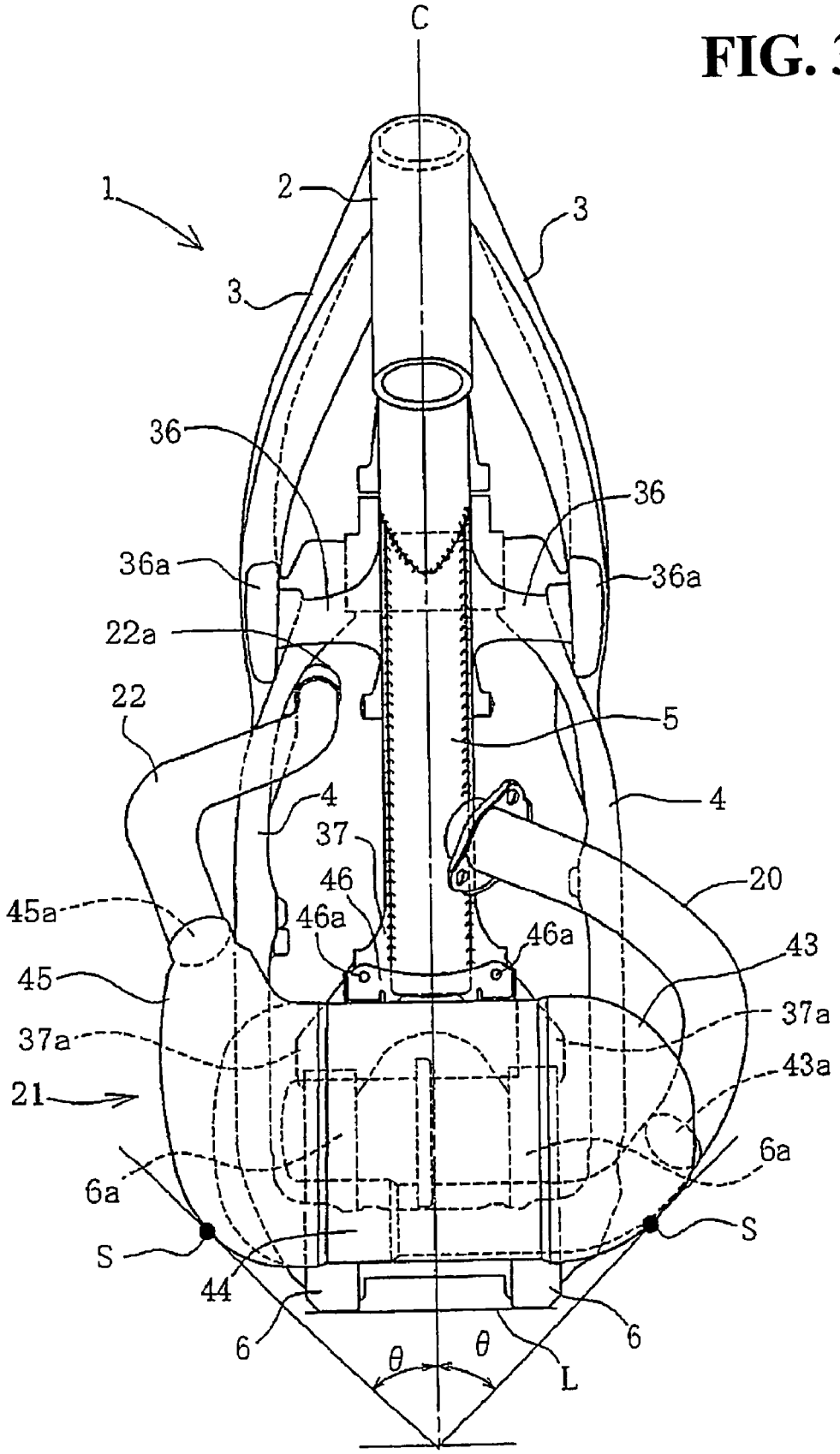
FIG. 3 is a view of a body frame and an exhaust system as seen from the direction of arrow B in FIG. 2.

FIG. 3 is a front view of the body frame 1 and the muffler 21. The muffler 21, lying horizontally long so as to be wide transversely (in the left-right direction), is a relatively large-capacity component extending left and right, which includes an inlet cap 43, a main portion 44 and an outlet cap 45. The inlet cap 43 and the outlet cap 45 each virtually take the form of a funnel protruding upward and the inlet cap 43 is fitted to the main portion 44 lying on vehicle body centerline C, covering an opening from left and the outlet cap 45 is fitted from right.

The exhaust pipe 20 extends downward curving in a way to protrude left outward from the vicinity of the vehicle body centerline C and joins an inlet **43*a* at the rearmost end of the inlet cap 43. The tail pipe 22 extends upward obliquely and backward on the right side of the vehicle body from an outlet 45*a* at the highest end of the outlet cap 45**.

In the body frame 1, the head pipe 2 and the down frame 5 are each singly arranged vertically along the vehicle body centerline C. Left and right main frames 3, center frames 4 and lower frames 6 are arranged in pairs. The left and right ends of the muffler 21 protrude more outward than the left and right lower frames 6 and the left and right center frames 4 where points S as their outer bottom points determine banking angle q.

The points S which determine the banking angle for the inlet cap 43 and outlet cap 45 on the left and right are transversely symmetrical, taking care that the left and right banking angles q are equal. In this front view, the lower ends of the lower frames 6 are visible under the lower end of the muffler 21.

The exhaust pipe 20 is connected with the inlet 43*a* at the back of the rear lower portion of the inlet cap 43 located in a left lower portion of the muffler 21. The tail pipe 22 extends upward obliquely and backward on the right side of the vehicle body from the outlet 45*a* as the upper protruding end of the outlet cap 45 provided in a right upper portion of the muffler 21 and once gets right of the center frame 4, then curves back inward in the vehicle body and extends backward between the down frame 5 and the center frame 4.

The down frame 5 singly extends downward from the head pipe 2 along the vehicle body centerline C and stiffeners 36 as left and right branches of its upper portion extend like a bowl. Integrally formed expanded main joints 36*a* at their tips abut on the bottom surfaces of the paired left and right main frames 3 respectively and their peripheries are welded. The rear end of the tail pipe 22 runs under the stiffeners 36 through a space surrounded by the main frames 3, center frames 4 and down frame 5, extending backward.

The lower end of the down frame 5 has a lower joint 37 as a point of bifurcation and a pair of left and right branches 37*a* integrally formed with the lower joint 37 are connected with the respective front ends 6*a* of the paired left and right lower frames 6 and welded together. A stay 46, provided on the upper surface of the main portion 44 of the muffler 21, is fixed with a bolt 46*a* on a front surface of the lower joint 37.

Figure 4:
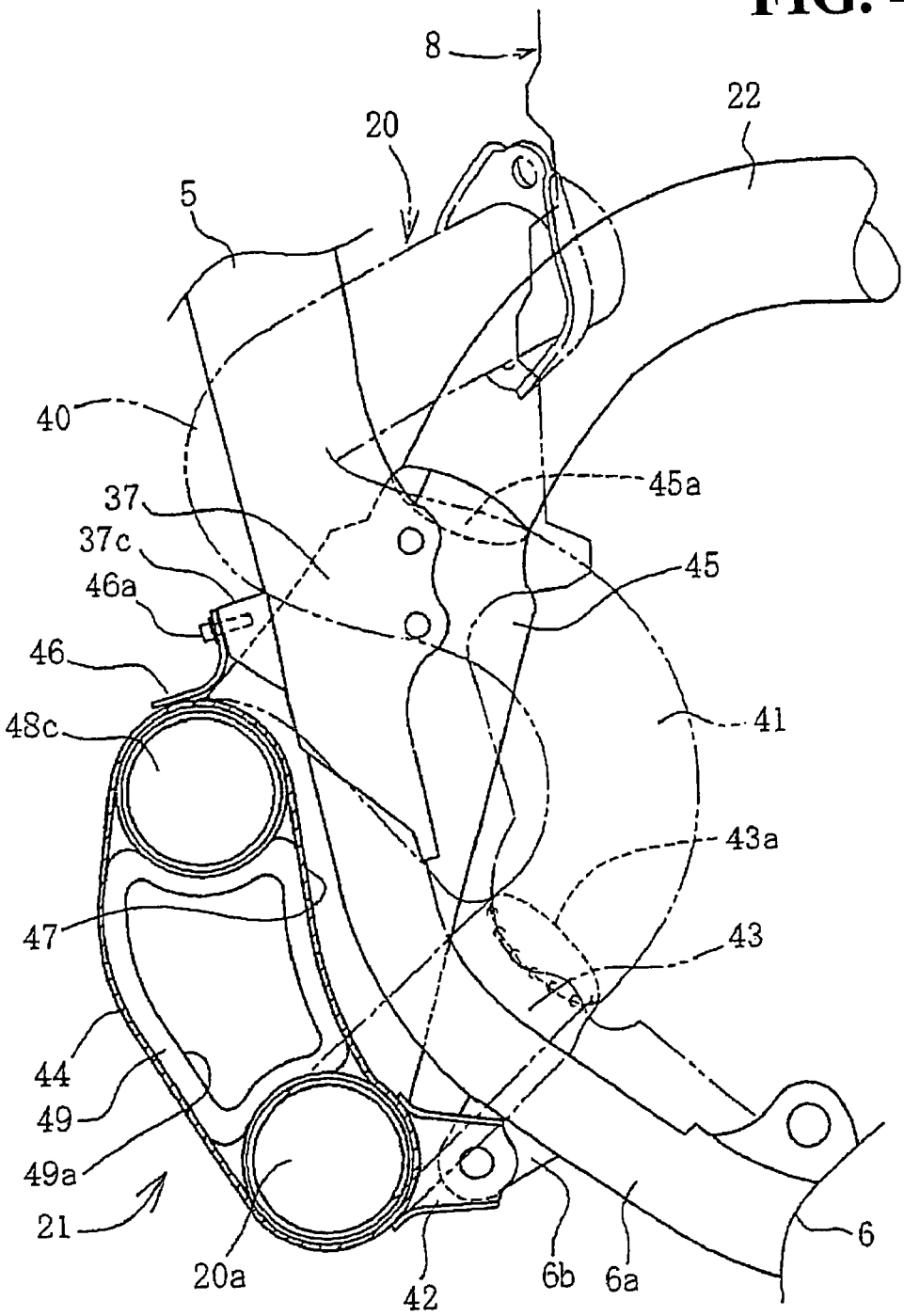
FIG. 4 is a fragmentary sectional view showing the positional relation between the muffler and the front frame.

FIG. 4 is a left side view mainly showing an exhaust system including the exhaust pipe 20, muffler 21 and tail pipe 22, where a cutaway section of the muffler 21 is shown in order to illustrate the relation between the muffler 21 and the body frame 1. As apparent from this figure, the rear wall 47 of the muffler 21 curves forward in a convex pattern, extending vertically in front of the down frame 5 and the front end 6*a* of the lower frame 6, keeping a small clearance from them.

The front end of the lower frame 6 extends upward along the curved surface of a front lower surface of the crankcase 9, curving forward in a convex pattern and joins the branches 37*a* at the lower joint 37 of the down frame 5. Thus, the rear wall 47 of the muffler 21 runs from ahead of the lower joint 37 along an area ahead of the front end 6*a* of the lower frame 6 under the joint with the branches 37*a* and in its vicinity. This makes it possible to decrease the amount of forward protrusion of the muffler 21 from the crankcase 9. In the figure, reference numeral 37*c* represents a boss for mounting the stay 46 formed on a surface of the lower joint 37.

Figure 5:
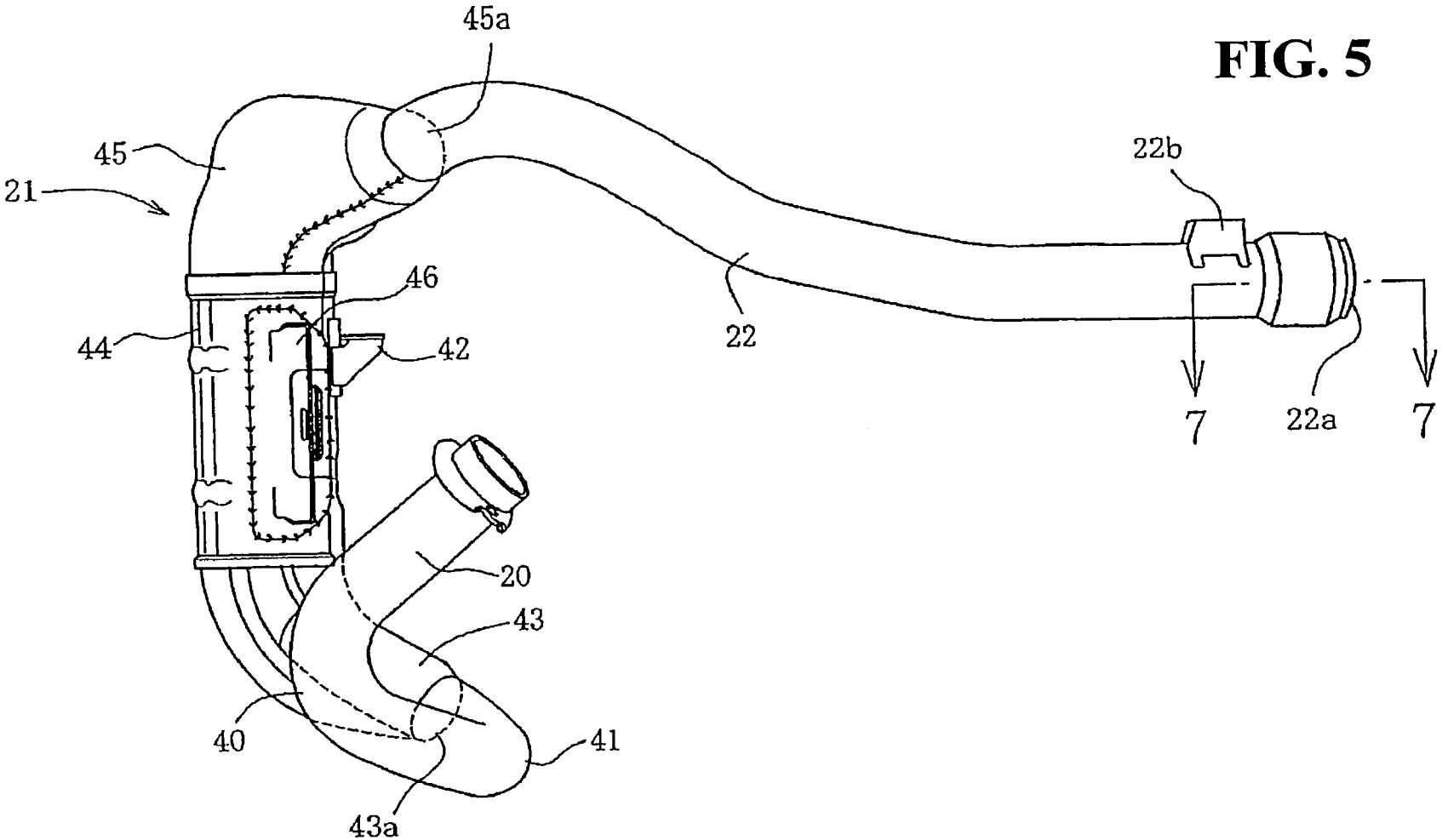
FIG. 5 is a plan view of the exhaust system.

FIG. 5 is a plan view of the exhaust system where the main portion 44 takes the form of a hollow cylinder that opens left and right with the inlet cap 43 and the outlet cap 45 welded integrally at both the left and right sides thereof. The inlet cap 43 and the outlet cap 45 each consist of a front half and a rear half. After the front and rear halves are joined to make a hollow cap, the joint is welded. Reference numeral 22*a* represents a bracket for fitting the rear end 22*a* of the tail pipe 22 to the auxiliary pipe 16 (FIG. 1).

Figure 6:
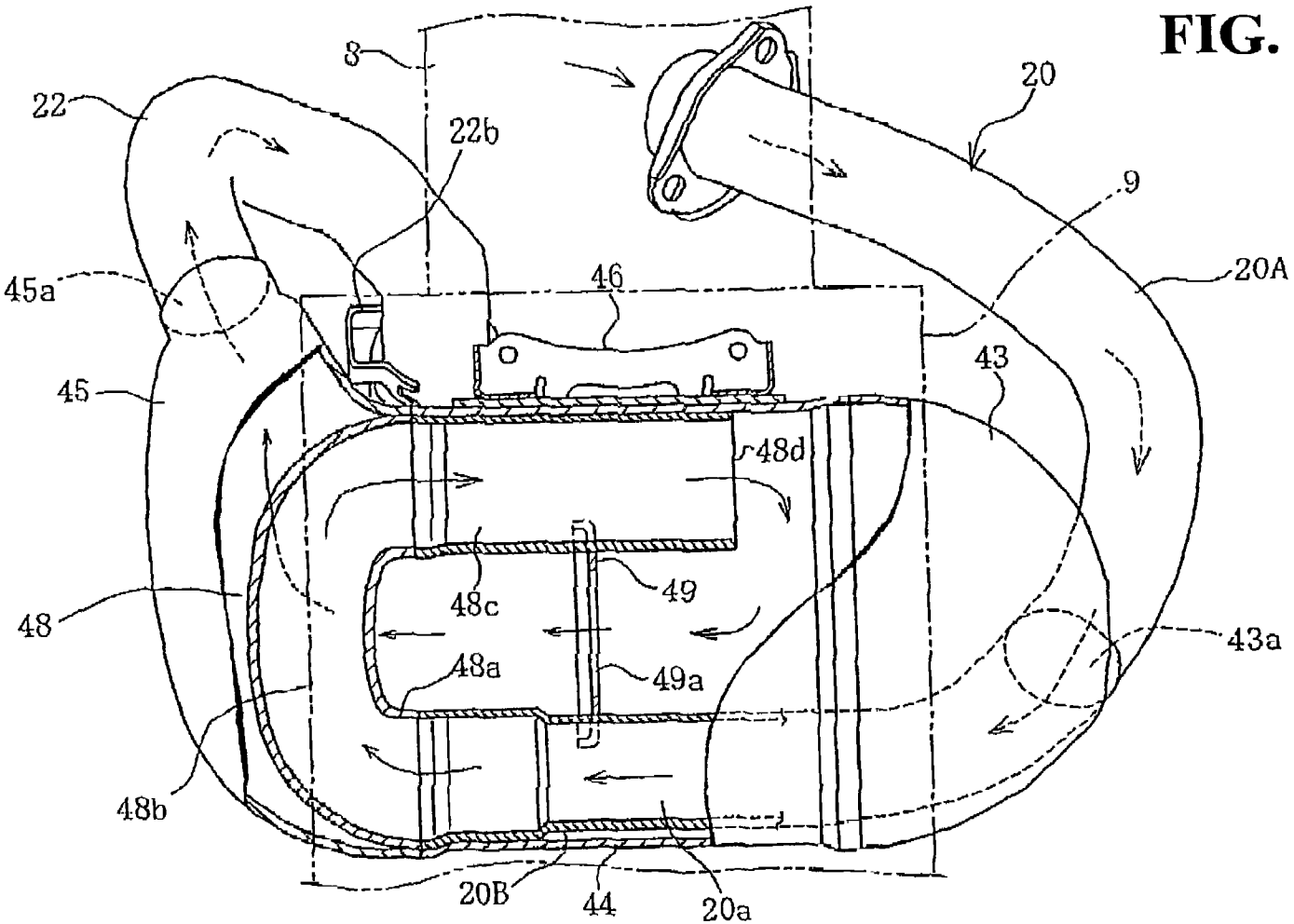
FIG. 6 is a front view of the above including a partial cutaway view.

FIG. 6 is a view of the exhaust system as seen from the direction of arrow B in FIG. 2 including a partial cutaway view of the muffler 21, where the exhaust pipe 20 enters, as an extension 20*a*, the inlet cap 43 through the inlet 43*a* and extends horizontally toward the main portion 44 on the bottom of the inlet cap 43 and, inside the main portion 44, joins a front portion 48*a* of a bend 48.

The bend 48 is a pipe member including a front portion 48*a* and a rear portion 48*c* that are horizontal and vertically parallel to each other, and a middle portion 48*b* that connects them vertically. The front portion 48*a* lies horizontally on the main portion 44 and the bottom of the joint of the outlet cap 45. The middle portion 48*b* is in an upright position inside the outlet cap 45 extending from the bottom to the top with its upper end continuous with the rear portion 48*c*. The rear portion 48*c* lies horizontally from the outlet cap 45 along the line from the joint of the main portion 44 to the top where its downstream end 48*d* is open in the vicinity of the inlet cap 43.

In the exhaust system as seen from ahead of the vehicle body in FIG. 6, the exhaust pipe 20 includes a side curved portion 20A which extends downward from the upper front surface of the cylinder 8 while curving outward on one side of the vehicle body. A horizontally extended portion 20B extends from the lower end of the side curved portion 20A ahead of the crankcase 9 in the transverse direction of the vehicle body and bends back in an opposite direction. The cylinder 8 and the crankcase 9 are schematically shown.

The side curved portion 20A includes the forward curved portion 40 and the rear curved portion (FIG. 2) and includes an exhaust upstream portion of the extension 20*a* entering the inlet cap 43 through the inlet 43*a*. The horizontally extended portion 20B includes an exhaust downstream portion of the extension 20*a* and the bend 48, and the rear portion 48*c* is in a position bending in an opposite direction with respect to the extension 20*a* in a vertical plane.

The extension 20*a* and the rear portion 48*c* are connected by a spacer ring 49 to prevent vibration of the rear portion 48*c*. The spacer ring 49 has a center hole 49*a* as shown in FIG. 4 and this center hole 49*a* allows the inner spaces of the inlet cap 43, main portion 44 and outlet cap 45 to communicate with each other. Hence, exhaust gas flows through the following components in the following order: exhaust pipe 20 to extension 20*a* to front portion 48*a* to middle portion 48*b* to rear portion 48*c* to inlet cap 43 to main portion 44 to outlet cap 45 to tail pipe 22.

The exhaust air which has passed through the extension 20*a* and the bend 48 goes out through the rear portion 48*c* and expands into the inner spaces of the inlet cap 43 and the main portion 44 and diffuses while further continuing to expand toward the outlet cap 45, thereby reducing the exhaust air energy, then goes through the outlet cap 45 with a tapered downstream portion to reach the outlet 45*a*. During this process, the exhaust sound is sufficiently reduced.

Figure 7:
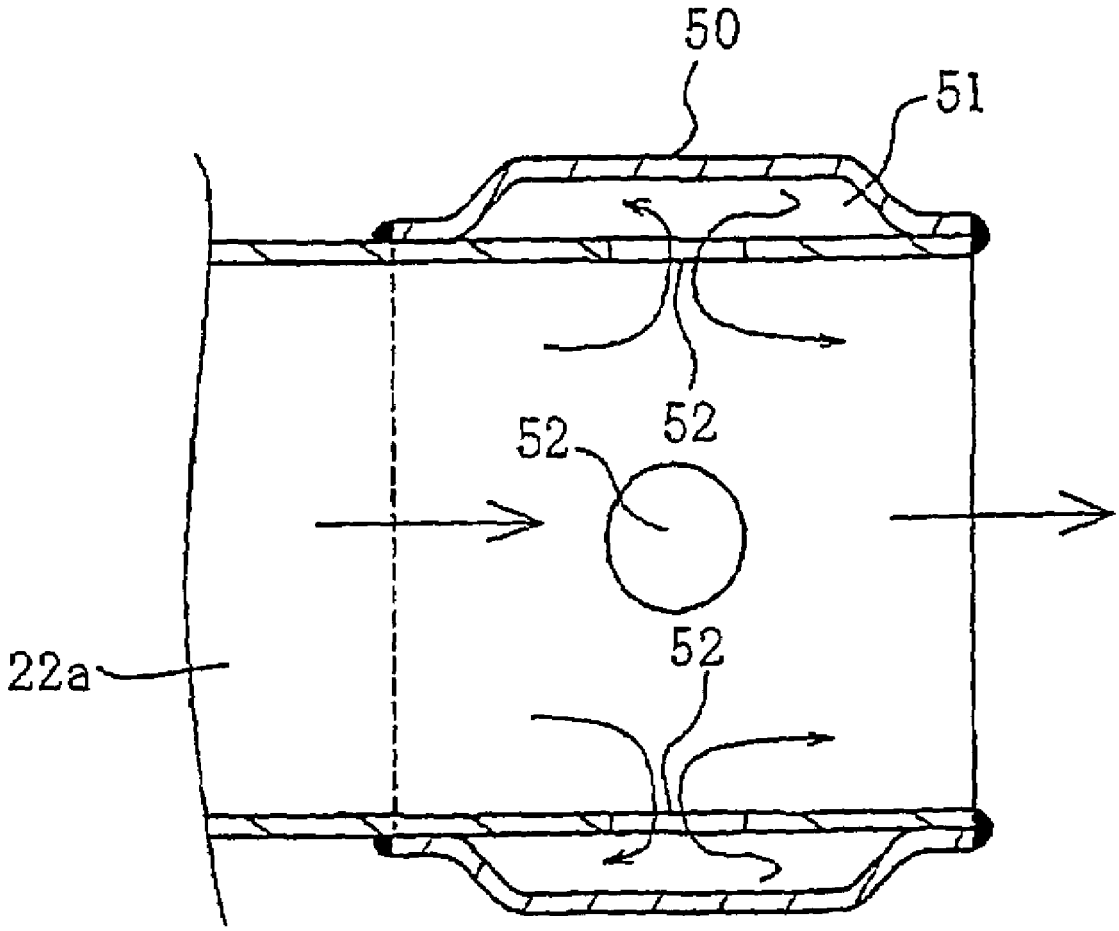
FIG. 7 is a sectional view taken along the line 7-7 in FIG. 5.

FIG. 7 is a sectional view taken along the line 7-7 in FIG. 5, where the rear end 22*a* of the tail pipe 22 has a double structure with a band-like covering member 50 wound and welded around the whole outer periphery and space 51 communicates with the inside of the tail pipe 22 through a through hole 52 made in the rear end 22*a* of the tail pipe 22. Therefore, the exhaust air again expands into the space 51 at the outlet and the space 51 also functions as a resonator so that the final exhaust sound level is further decreased.

The functions of this embodiment will now be described. As shown in FIG. 2, the muffler 21 is located ahead of the crankcase 9 and behind point P as the rear end of the front wheel 24 with the front fork 23 constituting a front suspension in its most retracted position and also above point R as the lowest end of the body frame 1. Therefore, the muffler 21, which is a relatively large-capacity and is a large and heavy component, can be in a position nearer to the head pipe 2 without interfering with the front wheel 24. Hence, when the vehicle body moves centering around the head pipe 2, the inertia force is reduced, which is suitable for an off-road motorcycle.

In addition, the muffler 21 is located ahead of the crankcase 9, namely the muffler is not located under the engine 7 which has an upright cylinder 8 and is longitudinally short. Therefore, a high minimum road clearance is ensured, which is also suitable as an exhaust structure for an off-road motorcycle.

Furthermore, the muffler 21 is located under the rear end of the high front fender 24*a* located above the front wheel 24. Therefore, the muffler can be in a position not to interfere with the front fender 24*a*.

As shown in FIG. 4, the down frame 5 and the lower frame 6 constitute the front frame. Even though the vicinity of the joint between the down frame 5 and the lower frame 6 is curved forward in a convex pattern, the rear surface of the muffler is curved along this curved portion, so that it can be in a position as near to the front lower portion of the crankcase as possible.

The exhaust pipe 20, which extends forward and downward from the cylinder head 11, includes an upper forward curved portion 40 and a lower backward curved portion 41, and the backward curved portion 41 is connected with a rear lower portion of the muffler 21. Therefore, a sufficiently long exhaust pipe length is ensured although the exhaust port of the cylinder head 11 is relatively near to the muffler 21.

As shown in FIG. 6, the exhaust pipe 20 includes a side curved portion 20A and a horizontally extended portion 20B and the horizontally extended portion 20B is fitted in the muffler 21 and is bent on the left and right with the downstream end 48*d* open into the muffler 21. This ensures that that the exhaust pipe is sufficiently long and can be arranged in a compact manner by taking advantage of the inside of the large-capacity muffler extending transversely.

The present invention is not limited to the above embodiment and can be modified or applied in various forms within the principle of the invention. For instance, it is also possible that the extension 20*a* and the bend 48 are porous and a sound absorbing material such as glass wool is wound around them to absorb sound. It is also possible that a rear muffler separate from the muffler 21 is connected with the tail pipe 22. In this case, exhaust sound is reduced more effectively; even in this case, the rear muffler may be an auxiliary muffler, which is small and lightweight. One or more such rear mufflers 1 may be provided.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust structure for a motorcycle, the motorcycle including a body frame supporting a front wheel and an engine, the engine including a crankcase and a cylinder extending upward from the crankcase, said exhaust structure comprising:

an exhaust pipe extending from the cylinder of the engine; and a muffler, the exhaust pipe being connected with the muffler, wherein the muffler is located ahead of the crankcase and behind the front wheel when a front suspension of the motorcycle is in a retracted position, and wherein the exhaust pipe is connected with an upper front of the cylinder and the exhaust pipe includes:

a side curved portion extending downward while curving on one side of a vehicle body, a horizontally extended portion extending from a lower end of the side curved portion ahead of the crankcase in a transverse direction of the body and bending in an opposite direction, and an exhaust downstream end of the horizontally extended portion being connected with the inside of the muffler.

2. The exhaust structure according to claim 1, wherein the muffler is located above a lower end of a body frame.

3. The exhaust structure according to claim 1, wherein the body frame has a front frame extending downward from the head pipe and extending downward from ahead of the engine and a rear surface of the muffler is curved along the front frame.

4. The exhaust structure according to claim 2, wherein the body frame has a front frame extending downward from the head pipe and extending downward from ahead of the engine and a rear surface of the muffler is curved along the front frame.

5. The exhaust structure according to claim 1, wherein a high front fender is located above the front wheel and the muffler is located under a rear end of the front fender.

6. The exhaust structure according to claim 2, wherein a high front fender is located above the front wheel and the muffler is located under a rear end of the front fender.

7. The exhaust structure according to claim 1, wherein the exhaust pipe includes an upper forward curved portion and a lower backward curved portion and the backward curved portion is connected with a rear lower portion of the muffler.

8. The exhaust structure according to claim 2, wherein the exhaust pipe includes an upper forward curved portion and a lower backward curved portion and the backward curved portion is connected with a rear lower portion of the muffler.

9. The exhaust structure according to claim 1, wherein the down frame and the lower frame are connected at a joint, and the muffler is located to cover an area in front of the joint.

10. A motorcycle, comprising:

a body frame with a head pipe supporting a front wheel;

an engine supported by the body frame, said engine including:

a crankcase in a lower position of the engine; and a cylinder extending upward from the crankcase;

an exhaust pipe extending from the cylinder; and a muffler, the exhaust pipe being connected with the muffler, wherein the muffler is located ahead of the crankcase and behind the front wheel when a front suspension of the motorcycle is in a retracted position, and wherein the exhaust pipe is connected with an upper front of the cylinder and the exhaust pipe includes:

a side curved portion extending downward while curving on one side of a vehicle body, a horizontally extended portion extending from a lower end of the side curved portion ahead of the crankcase in a transverse direction of the body and bending in an opposite direction, and an exhaust downstream end of the horizontally extended portion being connected with the inside of the muffler.

11. The motorcycle according to claim 10, wherein the muffler is located above a lower end of the body frame.

12. The motorcycle according to claim 10, wherein the body frame has a front frame extending downward from the head pipe and extending downward from ahead of the engine and a rear surface of the muffler is curved along the front frame.

13. The motorcycle according to claim 11, wherein the body frame has a front frame extending downward from the head pipe and extending downward from ahead of the engine and a rear surface of the muffler is curved along the front frame.

14. The motorcycle according to claim 10, wherein a high front fender is located above the front wheel and the muffler is located under a rear end of the front fender.

15. The motorcycle according to claim 11, wherein a high front fender is located above the front wheel and the muffler is located under a rear end of the front fender.

16. The motorcycle according to claim 10, wherein the exhaust pipe includes an upper forward curved portion and a lower backward curved portion and the backward curved portion is connected with a rear lower portion of the muffler.

17. The motorcycle according to claim 11, wherein the exhaust pipe includes an upper forward curved portion and a lower backward curved portion and the backward curved portion is connected with a rear lower portion of the muffler.

18. The motorcycle according to claim 10, wherein down frame and the lower frame are connected at a joint, and the muffler is located to cover an area in front of the joint.

* * * * *